United States Patent [19]

Gable et al.

[11] 4,401,425

[45] Aug. 30, 1983

[54] SAFETY SWITCH FOR A COMBUSTION SYSTEM

[75] Inventors: Gerald K. Gable, Carmel; Daniel J. Dempsey, Indianapolis, both of Ind.

[73] Assignee: Carrier Corporation, Syracuse, N.Y.

[21] Appl. No.: 207,856

[22] Filed: Nov. 18, 1980

[51] Int. Cl.[3] ..... F23N 5/24

[52] U.S. Cl. ..... 431/22; 431/21

[58] Field of Search ..... 431/21, 22, 16; 126/112, 110 R

[56] References Cited

U.S. PATENT DOCUMENTS

| | | | |
|---|---|---|---|
| Re. 28,013 | 5/1974 | McLarty | 431/16 X |
| 3,111,978 | 11/1963 | Peoples | 126/110 R |
| 3,537,803 | 11/1970 | Ignazio | 431/77 X |

*Primary Examiner*—William E. Wayner

*Attorney, Agent, or Firm*—Donald F. Daley; David L. Adour

[57] ABSTRACT

This invention relates to a method and apparatus for shutting down a combustion system when a pressure greater than atmospheric pressure is present in the flue pipe of the system. The apparatus comprises a connector means for connecting the flue pipe of the system with the surrounding atmosphere and a thermal switch which is in thermal contact with and responds to the gases within the connector means. The apparatus is especially useful as a safety device for shutting down an induced draft combustion system when the flue pipe of the system is blocked. Also, the apparatus can be used with a combustion system having a flue outlet vent which is also used as the outlet vent for another combustion system.

5 Claims, 2 Drawing Figures

SAFETY SWITCH FOR A COMBUSTION SYSTEM

BACKGROUND OF THE INVENTION

The present invention relates generally to furnaces or combustion systems and particularly to a control device for shutting down a combustion system when pressure in the venting system exceeds atmospheric pressure. Specifically, the present invention relates to a device for bringing the products of combustion within the flue pipe of a combustion system into contact with a thermal switch when abnormal conditions in the flue or venting system cause an increase in pressure above atmospheric pressure. The thermal switch is electrically connected to a fuel supply system of the combustion system and shuts down the system when the hot products of combustion from the flue pipe contact the thermal switch indicating that a pressure greater than atmospheric pressure is present in the flue pipe.

A combustion system, such as a furnace, normally contains a combustion chamber wherein fuel such as natural gas or oil is burned creating hot gaseous products of combustion, a heat exchanger wherein the heat from the products of combustion is transferred to another medium such as air or water, and a flue or vent system wherein the gases, now referred to as flue gases, pass from the heat exchanger to atmosphere at a remote location. In a natural draft combustion system the products of combustion pass over a heat exchanger and are collected at a draft hood or other such device. The draft hood is connected to a flue pipe whereby the flue gases are drawn into the flue pipe from the draft hood due to the natural draft of the vent system. In a forced draft system a fan is located upstream of the combustion chamber and forces air into the combustion chamber and the products of combustion through the heat exchanger into the flue. In an induced draft system a fan is located between the heat exchanger and the flue and draws air into the combustion chamber and draws the products of combustion through the heat exchanger into the flue.

In the natural draft system the flue or vent system usually contains a means, such as a draft hood or a draft diverter, for preventing pressure buildup in the flue if the flue is blocked. Draft hoods consist of an opening in the flue system covered by a hood. The opening allows the flue gas to vent to the atmosphere surrounding the furnace when pressure above atmospheric builds up in the flue. When the flue is functioning normally the reduced pressure in the flue draws air through the opening into the draft hood and up the flue.

In addition to providing relief for pressure in the flue, the draft hood provides dilution of the products of combustion. That is, the temperature and humidity of the products of combustion are reduced by mixing with air taken in through the draft hood opening. The air drawn into the flue through the draft hood relief opening is air which surrounds the combustion system and, in most instances, has been heated to room temperature. This, in effect, is a heat loss. That is, energy in the form of gas or oil has been used to heat the air which is subsequently drawn into the flue and expelled to the atmosphere. Reduction or elimination of this dilution air reduces the heat loss and improves the system efficiency.

One method for eliminating the heat loss of a draft hood while providing the safety features of the hood is to place a pressure responsive device in communication with the gases flowing through the combustion system so that the system is shut down when the device senses a preselected positive pressure. For example, U.S. Pat. No. 2,640,447 to Blum discloses a safety system for use in an incinerator whereby the pressure within the fire box of the incinerator is sensed and a switch responsive to the sensed pressure operates to shut down the system if the pressure exceeds a given value. Pressure sensitive devices are very sensitive and fast acting. This type of response is undesirable since pressure variations within the flue are quite common due to varying temperatures of operation, external wind conditions at the flue pipe outlet, natural down drafts and other such phenomena. Therefore, pressure sensitive devices are designed to respond to a relatively high positive pressure, that is, to a pressure substantially above atmospheric. Also, these pressure devices are not designed to provide protective functions for a combustion system when the products of combustion from this first combustion system are discharged through an outlet vent also used as the outlet vent for another combustion system. Connecting the vent system of a second combustion system to a common outlet vent provides a passage whereby the products of combustion from the first combustion system can escape when there is a blockage in the common outlet vent thereby preventing the buildup of pressure within the vent system of the first combustion system. This pressure buildup is essential to the proper operation of a pressure responsive device.

It is desirable to have a device which will not shut down a combustion system in response to normal fluctuations in pressure but will detect a small pressure increase above atmospheric pressure and shut down a combustion system in response thereto.

SUMMARY OF THE INVENTION

It is therefore an object of the present invention to provide a safety device for use in the vent system of a combustion system, to shut down the system if a pressure greater than atmospheric pressure is present in the vent system.

It is another object of the present invention to provide, in a combustion system, a safety shutdown control mechanism which responds to small increases in pressure within a flue without being responsive to normal fluctuations in pressure and which minimizes air losses to the system.

It is a further object of the present invention to provide a safety device for use in the vent system of a combustion system having a common outlet vent with another combustion system.

These and other objects of the present invention are accomplished by providing a safety device having a thermal switch in thermal contact with the gases within a connector means providing fluid communication between the flue pipe of a combustion system and the surrounding atmosphere. During normal operation of the combustion system a small amount of the surrounding air is drawn through the connector means into the fluid pipe of the combustion system. These cool gases from the surrounding atmosphere have no effect on the thermal switch. However, if hot gaseous combustion products flow through the connector means from the flue pipe into the surrounding atmosphere the thermal switch is activated and operates to shut down the combustion system. The flow of hot gaseous combustion products back through the connector means from the flue pipe is indicative of a malfunction such as a blocked flue.

Thus, the present invention provides effective safety protection eliminating the need for a draft hood and reducing energy losses resulting from the use of a draft hood. Also, the present invention provides the safety features of a pressure sensitive device without the disadvantage of having to be designed to be insensitive to small pressure increases to avoid spurious activation of the device and undesirable shutdown of the combustion system. The present invention provides a safety device having a thermal switch which is responsive to a very small sustained increase in pressure above atmospheric pressure. Furthermore, the present invention is suitable for use in a common vent system for two combustion systems.

DESCRIPTION OF THE PREFERRED EMBODIMENT

Figure 1:
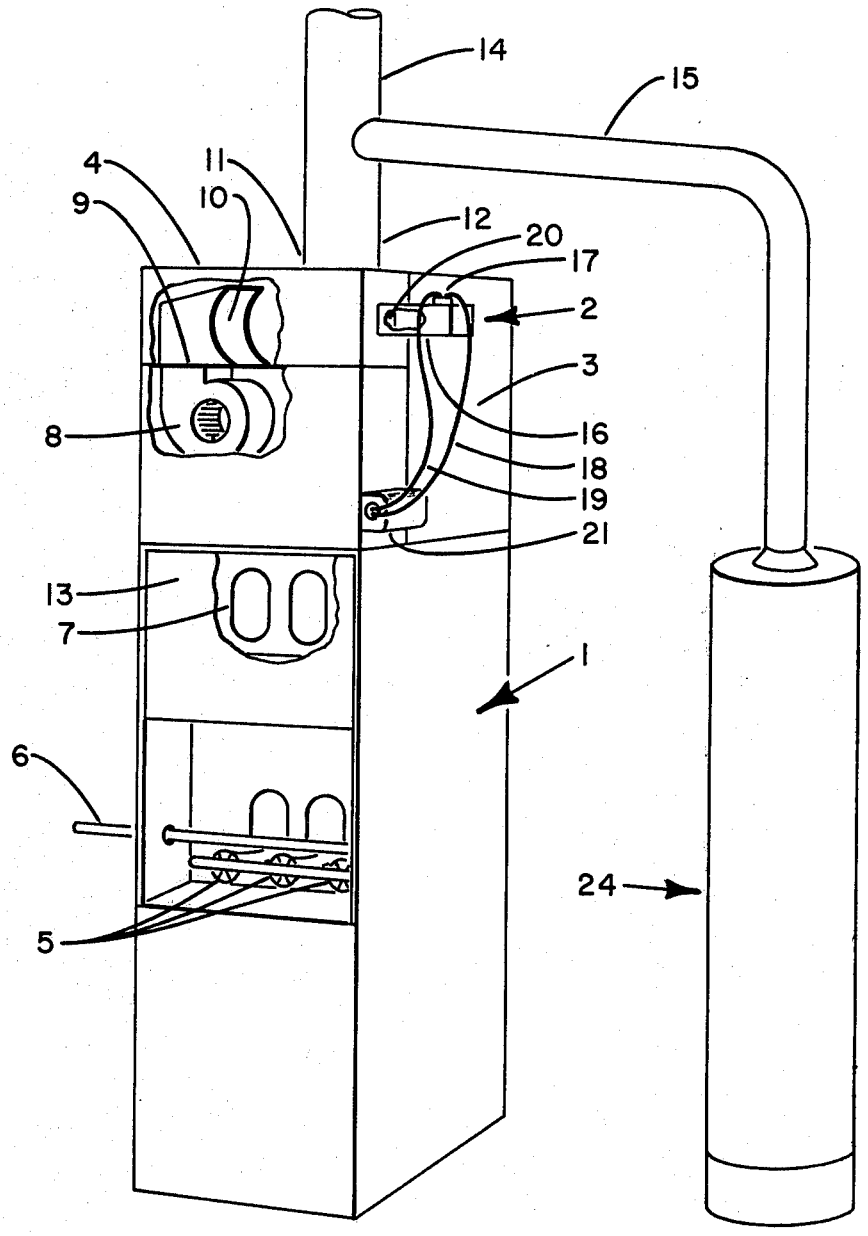
FIG. 1 depicts an induced draft furnace having a safeguard system constructed according to the principles of the present invention.

FIG. 1 depicts an induced draft furnace 1 having a control system or safeguard system 2 constructed and operated according to the principles of the present invention. The furnace 1 is used to heat an enclosure (not shown) by circulating heated fluid, known as primary fluid, through plenum 3 which transports the primary fluid to the enclosure. The safeguard system 2 is connected to a discharge box 4 which is part of the vent system of the furnace 1. The safeguard system 2 operates to shut down the furnace 1 when a pressure greater than atmospheric pressure is present within the discharge box 4.

In operation, fuel is fed to the burners 5 of the furnace 1 through inlet pipe 6. Air is also drawn into the burners 5 from the surrounding atmosphere. The fuel and air mixture is burned within the burners 5 generating hot gases products of combustion which are drawn through heat exchangers 7 due to an induced draft created by the operation of a fan unit 8.

The circulating fluid, that is the primary fluid, passes over the heat exchangers 7 to the plenum 3. The primary fluid is heated as it passes over the exchangers 7. The gaseous products of combustion are known as the secondary fluid. The remaining parts of the furnace 1, as shown in FIG. 1, relate to the vent system for the secondary fluid of the furnace 1.

The gaseous products of combustion from the heat exchanger 7 are collected in the flue collector box 13 and are drawn through the fan unit 8 and discharged through opening 9 into the discharge box 4. The discharge box 4 may contain a baffle 10 for directing the flow of combustion products from the opening 9 to the opening 11 which is connected to the flue pipe 12. The use of a discharge box 4 is preferable for use with the present invention. However, the use of a discharge box 4 is not required. The gaseous products of combustion from the fan unit 8 could be discharged directly into the flue pipe 12 and the safeguard system 2 attached directly to the flue pipe 12. The gaseous products of combustion from the flue pipe 12 are vented to the external environment through outlet vent 14.

The present invention is designed to allow operation of another combustion system having its flue pipe also connected to the same outlet vent 14 serving an induced draft or power draft combustion system. Discharge conduit 15, as shown in FIG. 1, shows how another combustion system might be connected to the outlet vent 14 to form a common outlet for the two combustion systems.

The safeguard system 2, as shown in FIG. 1, is attached to the discharge box 4 of the furnace 1. The safeguard system 2 comprises a connector means 16 and a thermal switch 17 having electrical leads 18 and 19 connected thereto. The connector means 16 is connected to the discharge box 4 through opening 20. The connector means 16 may be rectangular or any other shape as long as the connector means 16 communicates with the surrounding atmosphere to allow flow into or out of the discharge box 4 depending on the pressure in the box 4 relative to the surrounding atmospheric pressure. The thermal switch 17 is attached to the connector means 16 so that gases flowing through the connector means 16 are in thermal contact with the switch 17.

Figure 2:
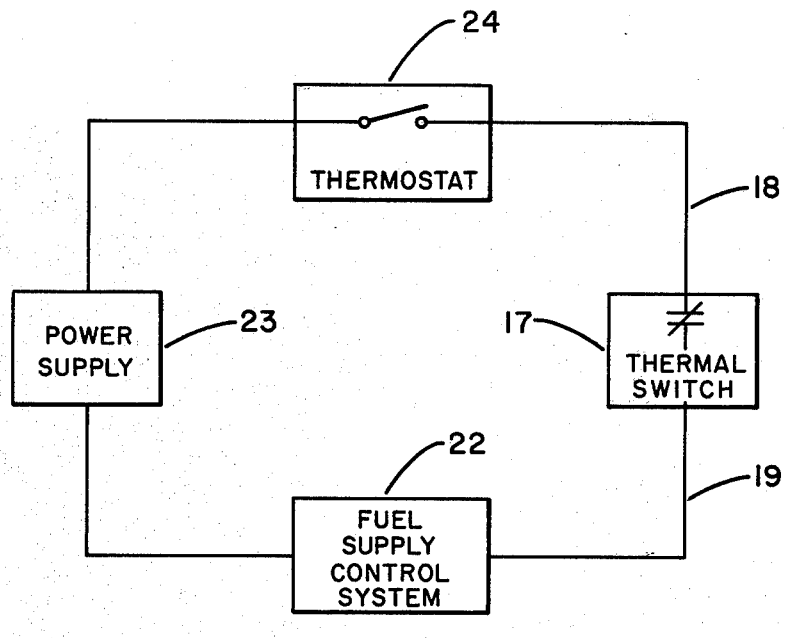
FIG. 2 is a block diagram showing an arrangement of circuit elements, including the thermal switch of the safeguard system shown in FIG. 1, for controlling the operation of a fuel supply system for the furnace shown in FIG. 1.

Electrical leads 18 and 19 are connected to the controller 21 for the furnace 1. The connector 21 provides electrical control of the operation of the furnace 1 including electrical control for the fuel supply control system 22 of the furnace 1. As shown in FIG. 2, electrical leads 18 and 19 are connected so that the control switch 17 is in series with a thermostat 24 for the furnace 1 and in series with the fuel supply control system 22. The thermostat 24 and the switch 17 control the flow of current from a power supply 23 to the fuel supply control system 22. The fuel supply control system 22 includes a solenoid operated fuel supply valve which controls the flow of fuel to the burners 5 of the furnace 1. When power flows to the fuel supply control system 22 from the power supply 23 the solenoid operates to open the fuel supply valve allowing fuel to flow to the burners 5. The solenoid operates to close the fuel supply valve when power does not flow to the fuel supply control system 22. During normal operation of the furnace 1 the thermostat 24 is closed and the switch 17 is in a normally closed position. However, if the switch 17 senses a high temperature the normally closed switch 17 opens. This prevents the flow of power to the fuel supply control system 22 thereby closing the fuel supply valve and shutting down the furnace 1.

The detailed operation of the draft safeguard system 2 is as follows. During normal operation of the furnace 1, the fan unit 8 discharges the gaseous products of combustion from the burners 5 and heat exchanger 7 through opening 9 into the discharge box 4. There is a natural draft due to the density difference between the hot products of combustion in the vent system and the cool air surrounding the vent system. This natural draft draws the gaseous products of combustion entering the discharge box 4 into the flue pipe 12. If the discharge box 4 includes a baffle 10, the draft within the venting system can be further controlled by properly directing the flow between the opening 9 and the opening 11. Thus, during normal operation of the furnace 1, there is a negative pressure, that is, a pressure less than surrounding atmospheric pressure, within the discharge box 4 and flue pipe 12. This negative pressure within the vent system draws the surrounding air into the discharge box 4 through the connector means 16. The connector means 16 is relatively small compared to the dimensions of the flue pipe 12 to prevent the flow of large quantities of the surrounding heated air into the vent system of the furnace 1 during normal operation of the furnace 1.

The flow of surrounding air into the vent system of the furnace 1 continues in a steady state situation when the furnace 1 is operating normally. However, if a pressure greater than atmospheric pressure develops within the discharge box 4 hot gaseous products of combustion flow from the discharge box 4 through the connector means 16 to the surrounding air. The variation from designed operating pressure within the discharge box 4 is indicative of a malfunction such as a blocked outlet vent 14. Bringing the hot gaseous products of combustion into thermal contact with the thermal switch 17 for a sufficient period of time causes the switch 17 to open. The switch 17 acts as a circuit breaker to break the circuit between the thermostat 24 and the fuel supply control system 22 of the furnace 1 thereby closing the fuel supply valve and shutting down the furnace 1. The thermal switch 17 may be designed to shut down the furnace 1 after one to ten minutes of thermal contact with the hot gaseous products of combustion. This time delay allows the system to operate normally when fluctuations within the discharge box 4 are caused by variables such as natural down draft, varying atmospheric conditions and other such phenomena. The safeguard system 2 does not respond to these transient phenomena, thus preventing undesirable turning off of the furnace 1.

The thermal switch 17 is preferably a manual reset switch. This means that the switch must be manually closed after it has opened in response to sensing hot products of combustion. This prevents inadvertent recycling and operation of the furnace 1 after a fault has occurred until the system is checked to determine the cause of the prior fault.

The present invention is especially useful with a furnace 1 having a common outlet vent 14 with another combustion system. For example, as shown in FIG. 1, the flue pipe or discharge conduit 15 from another combustion system, such as a water heater 24, may be connected into the outlet vent 14 of the furnace 1. Thus, if a flue blockage or other such malfunction occurs in the common outlet vent 14 to result in the system developing a pressure greater than atmospheric pressure within the discharge box 4 some hot combustion products will flow through the connector means 16. The safeguard system 2 will then operate to shut down the system if such a blockage occurs.

This operation of the safeguard system 2 should be contrasted with the operation of a pressure responsive safety device. A pressure responsive device requires a substantial positive pressure to properly operate the device. If a pressure responsive device is used with a furnace 1 having an outlet vent 14 also used as the outlet vent for another combustion system, the outlet vent 14 may become blocked and the safety device not respond. For example, if the common outlet vent is blocked the products of combustion from the furnace 1 may be spilled through the discharge conduit 15 of the other combustion system back to the combustion chamber of the other system. The required pressure necessary to activate the pressure responsive safety device at the discharge box 4 may never develop because of the venting of the combustion products back to the other combustion system. Thus, the pressure responsive device would not operate properly to shut down the system in such a situation.

The pressure responsive device might be adjusted to give more sensitivity to respond to this situation. However, doing so results in undesirable activation of the device during normal operation of the furnace 1. This undesirable activation is due to the pressures associated with back drafts and other such phenomena as discussed previously. The present system eliminates this problem because the safeguard system 2 responds to the hot gaseous products of combustion of the system through temperature sensing. Temperature sensing is a more direct and reliable parameter for determining the proper operation of the furnace 1 than is pressure sensing, especially in the above-described blocked outlet vent situation.

While the present invention has been described for use in an induced draft combustion system, it is also capable of being used with a forced or natural draft combustion system. The safeguard system operates whenever a pressure less than ambient is normally present in the discharge conduit to which the device is attached. This is true in any natural draft appliance due to the density difference between hot air in the vent system and cool air surrounding the system. Also, the buoyancy effect of the hot combustion gases within the vent system aids in creating a substantial natural draft. The present invention can be used with such natural draft systems simply by adding the safeguard system to the flue pipe of the natural draft system. No modification of the structure of the safeguard system is required.

Other such modifications and uses of the present invention will be readily apparent to one of ordinary skill in the art to which this invention pertains. Therefore, it is to be understood that these modifications of the present invention may be made without departing from the scope of the invention heretofore described and claimed in the appended claims.

What is claimed is:

1. A vent system for a combustion system having a combustion chamber where products of combustion are generated and a heat exchanger through which the products of combustion are passed from the combustion chamber to the vent system, said vent system comprising:

a flue gas discharge box having an inlet opening, an outlet opening, and a relatively small third opening;

a fan unit for drawing products of combustion from the heat exchanger of the combustion system and for discharging these products of combustion into the flue gas discharge box through the inlet opening in the flue gas discharge box, said fan unit having a displacement relative to the size of the flue gas discharge box to provide a pressure in the flue gas discharge box below surrounding atmospheric pressure during normal operation of the combustion system;

a flue pipe means connected to the outlet opening of the flue gas discharge box, for receiving products of combustion from the flue gas discharge box;

a temperature sensing means located at the third opening in the flue gas discharge box for sensing the temperature of fluid flowing through the third opening and for generating a control signal when fluid temperatures above normal ambient temperature are sensed for a selected time duration indicating abnormal flow conditions in the vent system; and control means for terminating operation of the combustion system in response to generation of the control signal by the temperature sensing means.

2. A vent system for a combustion system as recited in claim 1 further comprising:

a tube means connected to the flue gas discharge box, for forming the third opening in the flue gas discharge box wherein the temperature sensing means is located, said tube means sized to prevent substantial dilution of products of combustion flowing through the vent system due to surrounding air flowing into the vent system through said tube means, and said tube means sized to allow sufficient fluid flow between the surrounding atmosphere and the vent system so that the temperature of this fluid may be sensed.

3. A vent system for a combustion system as recited in claim 1 further comprising:

a baffle means located within the flue gas discharge box for directing the flow of the products of combustion from the inlet opening in the box to the outlet opening in the box.

4. A common vent system for simultaneously discharging products of combustion from a first combustion system and from a second combustion system, comprising:

a first vent system operating at a pressure below surrounding atmospheric pressure, for discharging products of combustion from the first combustion system;

a second vent system operating at a pressure below surrounding atmospheric pressure, for discharging products of combustion from the second combustion system into the first vent system;

means for forming an opening in the first vent system at a location upstream of where products of combustion are discharged from the second vent system into the first vent system;

temperature sensing means, located at the opening formed in the first vent system, for sensing the temperature of fluid flowing through the opening and for generating a control signal when fluid temperatures above normal ambient temperature are sensed for a selected time duration indicating abnormal flow conditions in the vent system; and means for terminating operation of at least one of the combustion systems in response to generation of the control signal by the temperature sensing means.

5. A common vent system for simultaneously discharging products of combustion from a first combustion system and from a second combustion system, as recited in claim 4, wherein said means for forming an opening in the first vent system comprises:

a tube which is part of the first vent system and which is located upstream of where products of combustion are discharged from the second vent system into the first vent system, said tube sized to prevent substantial dilution of products of combustion flowing through the first vent system due to surrounding air flowing into the first vent system through said tube, and said tube sized to allow sufficient fluid flow between the surrounding atmosphere and the vent system so that the temperature of this fluid may be sensed by the temperature sensing means.

* * * * *